United States Patent [19]

Baker, II

[11] 4,145,031

[45] Mar. 20, 1979

[54] MODULAR DISMANTLEABLE FENCE

[76] Inventor: Ralph Baker, II, 6755 S. Settler, Tucson, Ariz. 85706

[21] Appl. No.: 867,922

[22] Filed: Jan. 9, 1978

[51] Int. Cl.[2] ..... E04H 17/14

[52] U.S. Cl. ..... 256/65; 256/73

[58] Field of Search ..... 256/19, 24, 21, 22, 256/25, 73, 65; 119/20

[56] References Cited

U.S. PATENT DOCUMENTS

| | | | |
|---|---|---|---|
| 851,936 | 4/1907 | Hendrich | 256/73 X |
| 915,131 | 3/1909 | Villard | 256/25 |
| 3,447,786 | 6/1969 | Bigni | 256/19 X |
| 3,808,757 | 5/1974 | Greenwood | 256/24 X |
| 3,910,560 | 10/1975 | Goetz | 256/24 |

FOREIGN PATENT DOCUMENTS

| | | | |
|---|---|---|---|
| 974783 | 10/1950 | France | 256/25 |

*Primary Examiner*—Andrew V. Kundrat
*Attorney, Agent, or Firm*—Cahill, Sutton & Thomas

[57] ABSTRACT

Each of a plurality of fence posts includes an upright supported on a base plate. Rails, having orthogonally apertured ends for penetratingly receiving the uprights, interconnect adjacent posts and define the fence. The vertical spacing between adjacent rails is determined by spacers mounted upon the uprights intermediate the apertured ends of proximate rails. Other spacers, having one-half of a hinge or one part of a two part lock mechanism, cooperate with corresponding elements extending from a gate to support and latch the gate. A detachably attached overhead post and lintel unit engages the uprights of the posts defining a gate way to lend structural integrity to the fence sections terminating at the gate way.

7 Claims, 4 Drawing Figures

MODULAR DISMANTLEABLE FENCE

The present invention relates to fencing and, more particularly, to modular knock-down fencing.

Often, the need arises to erect temporary fencing for containing livestock, exhibits and the like or simply to regulate pedestrian traffic. Because of the temporary nature of such fencing needs, the costs attendant conventional permanent or semi-permanent fences are prohibitive.

To reduce the costs of temporary fencing, various types of reuseable fence structures have been developed. U.S. Pat. No. 3,537,687 describes a collapsible multi-segment solid wall fence wherein the wall elements of the fence are detachably attached to one another by vertical rods engaging apertures within the wall elements. U.S. Pat. No. 915,131, illustrates a plurality of horizontal rods stackable with respect to one another by penetrating engagement with vertical rods to form fence sections. Consecutive fence sections are attached to one another in interleaved relationship by the same vertical rods. U.S. Pat. No. 1,655,764 is directed to a means for splicing a wire fence by having a vertical rod penetratingly engage laterally extended members secured to segregated wire fence segments. U.S. Pat. No. 3,499,631 describes the attachment of a plurality of horizontal fence members to vertical fence posts through engagement of locking tabs. U.S. Pat. No. 3,770,246 considers the possibility of attaching fence segments in serial fashion by means of interconnecting loops. Other United States patents generally directed to fence or fence-like structures include U.S. Pat. Nos. 610,803, 700,001, 2,628,823, 2,642,269, 3,034,610 and 3,698,692.

The modular dismantleable fence described in detail hereinafter is developed from a plurality of interlockable, easily transportable elements. Moreover, the manner for supporting the fence as a free-standing structure precludes the need for having the fence close upon itself, as is true with some of the prior art structures, in order to establish the requisite rigidity. Particular orientation of fence sections with respect to one another is not necessary to insure that the fence remain upright while being subjected to normal use.

The modular dismantleable fence includes a plurality of fence posts, each of which includes an upright supported upon a base plate. Each of a plurality of rails includes orthogonally apertured members at the ends thereof for penetratingly receiving an upright of a fence post. The spacing between proximate rails within a fence section is effected through spacers slidably receiving the upright and positioned intermediate the ends of proximate rails. The rails of an adjacent fence section are interleavingly mounted upon a common upright. Gates and the like are mounted intermediate adjacent fence posts by spacers having one-half of a hinge and one half of a lock mechanism, which half hinges lock mechanism cooperate with corresponding elements attached to the gate. The posts defining a gate way are interlocked through a removably attached overhead post and lintel structure whereby the bottom of the uprights are maintained in place by the plates and the upper end of the uprights are maintained in place by the post and lintel structure. The base plates, whether resting upon, attached to or buried in the soil, provide sufficient support to preclude the adjacent fence sections from being oriented with respect to one another in zigzag fashion and preclude the need for the structural rigidity attendant having the fence close upon itself. Each of the above described elements may be constructed from lightweight tubular material, depending, of course, upon the ultimate use of the fence. Thereby, transportation, as well as storage, of the various elements, is readily effected and the volume of a stored fence is minimized by the lack of odd-shaped elements or elements which, due to their configuration, require large storage volume.

It is therefore a primary object of the present invention to provide an easily erectable and dismantleable modular fence.

Another object of the present invention is to provide a dismantleable fence constructed of conventional tubing materials.

Still another object of the present invention is to provide a free-standing dismantleable fence.

Yet another object of the present invention is to provide a dismantleable fence erectable with a wide choice of vertical spacing between the rails.

A further object of the present invention is to provide a dismantleable fence supportable of gates without jeopardizing the structural integrity of the fence while such gates are open.

A still further object of the present invention is to provide a compactly storable dismantleable fence.

A yet further object of the present invention is to provide an inexpensively manufacturable dismantleable fence.

These and other objects of the present invention will become apparent to those skilled in the art as the description thereof proceeds.

The present invention may be described with greater specificity and clarity with references to the following drawings, in which.

Figure 1:
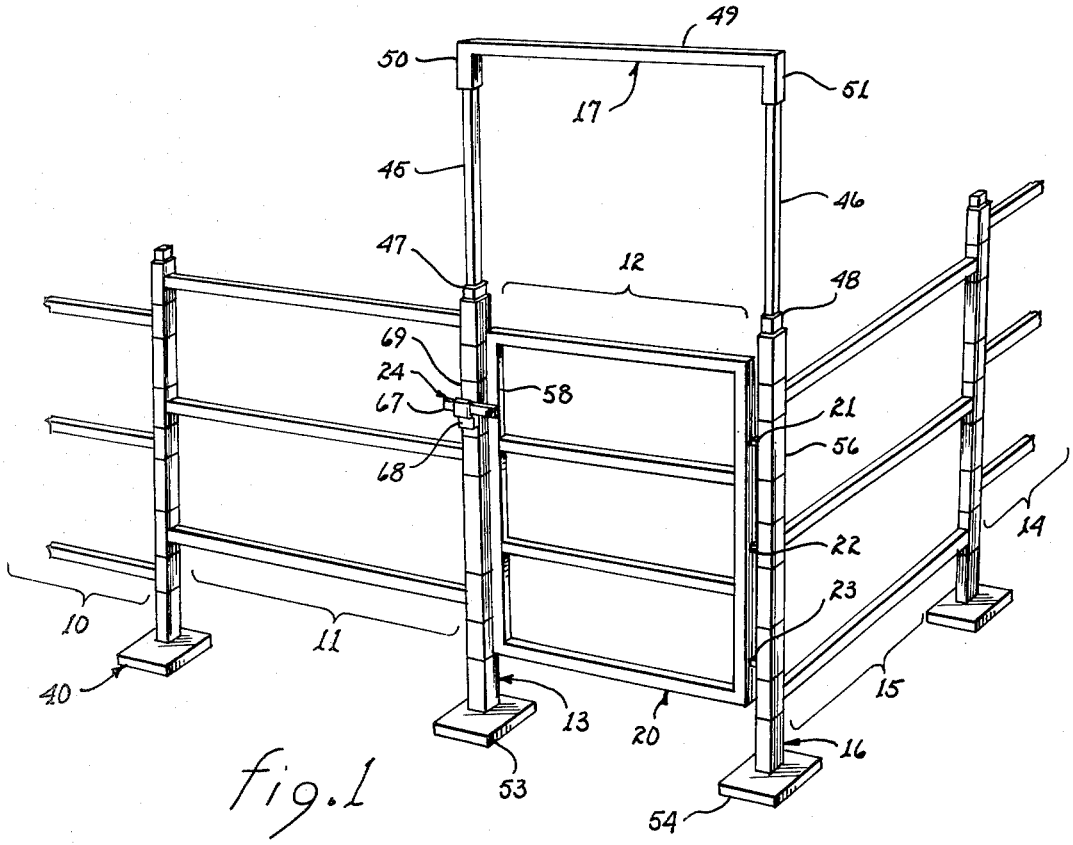
FIG. 1 is a perspective view illustrating a segment of a dismantleable fence supporting a gate.

Referring to FIG. 1, there are shown modular dismantleable fence sections 10 and 11 terminating at one side of gate way 12 defined by post 13. Similarly, fence sections 14 and 15 terminate at the opposite side of gate way 12 defined by post 16. A post and lintel apparatus 17 interconnects posts 13 and 16 across gate way 12 to lend structural integrity thereto. Gate 20 is pivotally attached to post 16 through hinges 21, 22 and 23; a lock mechanism or latch 24 secures the opposed side of gate 20 to post 13.

Figure 2:
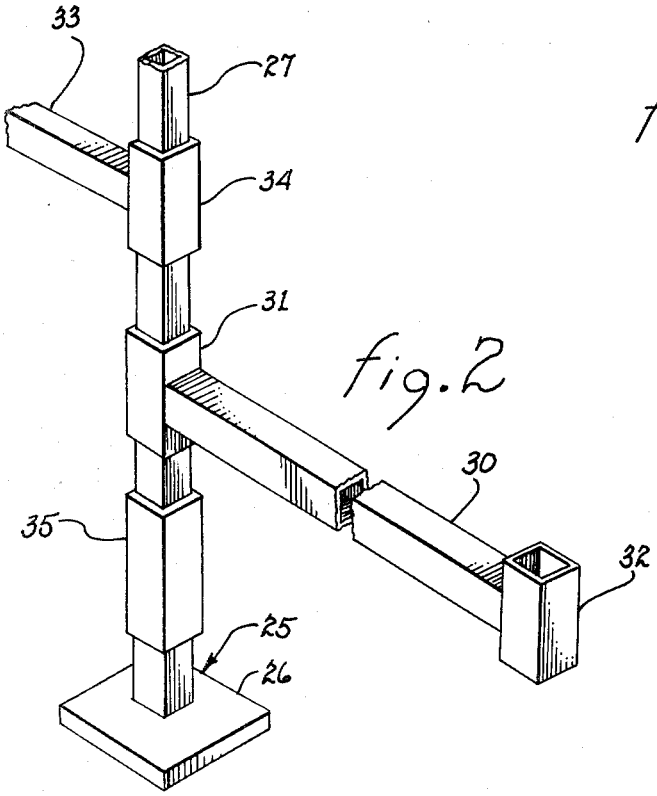
FIG. 2 illustrates the interlocking relationship of the major elements constituting the dismantleable fence.

The structural details of the various components cooperating with one another to define the modular dismantleable fence will be described with joint reference to FIGS. 1 and 2. Each post, such as post 25, includes a base plate 26 supporting an upright 27. As illustrated, the upright may be tubular and square-shaped in cross-section; alternatively, it may be a cylindrical tube or a square or cylindrical solid element; other configurations are also possible. The size of base plate 26 is dependent primarily upon the use to which the fence is to be put in conjunction with whether the base is to rest upon a surface, be buried beneath a surface or be staked or otherwise secured to a surface. Each rail, such as rail 30 includes a pair of orthogonally oriented ends 31 and 32. These ends are penetrably mounted upon upright 27. The vertical positioning of the rails is determined by sleeves or spacers 35 also penetrably mounted upon upright 27. The rails extending in opposed directions from upright 27, such as rails 30 and 33, are mounted upon the upright in interleaved relationship. The vertical displacement of rails 30 and 33 is primarily a function of the length of ends 31 and 34, respectively.

The rails of adjoining fence sections, such as sections 10 and 11, may be interleaved, as illustrated at post 40 (see FIG. 1). Such interleaving does not necessarily preclude the vertical spacing intermediate the rails of one of the sections from being different from the spacing intermediate the rails of the adjoining section. Instead, there is only a slight vertical offset between the rails of one section with respect to the rails of another section, which offset is a function of the length of the orthogonally oriented ends of the rails.

Post and lintel apparatus 17 includes a pair of stanchions 45 and 46 lockingly mating with the internal cavities of uprights 47 and 48 of posts 13 and 16, respectively. The upper ends of the stanchions are joined to one another by means of an inverted U-shaped member 49 having legs 50 and 51 for receiving the upper ends of the stanchions. Thereby, lateral displacement of the upper ends of uprights 47 and 48 is precluded by the structural integrity of stanchions 45 and 46 cooperating with the legs of U-shaped member 49. Since it is assumed that base plates 53 and 54 are not slidable upon the supporting surface, the lateral dimension of gate way 12 is maintained constant.

The use of square tubing, as illustrated, has certain inherent advantages over cylindrical tubing. In example, by using square tubing, pivotal movement of the rails about the longitudinal axis of supporting uprights is essentially precluded because of the physical interlocking relationship of the upright with the orthogonal ends of the rails. By using tubing square in cross-section rather than rectangular in cross-section, 90° changes in direction of the fence, as illustrated in FIG. 1, are readily effected with angular accuracy.

Square tubing, whether of aluminum, other metals or plastic is a relatively standard off-the-shelf item, which avoids the expenses attendant specially configured tubular extrusions. Furthermore, such tubing is available in graduated sizes whereby the spacers and orthogonal ends for the rails are available from stock items while maintaining the nesting capability. Accordingly, the only manufacturing functions necessary in making the present invention are those of: attaching the base plates to the uprights; attaching the orthogonal ends to the rails; and, cutting the various tubular sections to length. Such ease of manufacture reduces the costs attendant commercial exploitation of the present invention to an amount substantially less than that of any of the known prior art related devices.

Since the posts, rails and spacers are interchangeable, the exact number of elements necessary to erect a particular length fence can be purchased. Thereafter, additional elements can be purchased to lengthen the fence without obsolescence or waste of previously purchased elements. Therefore, a purchaser can tailor his purchase to any given specific need while having the assurance that any purchased items can be continued to be used should additional fence sections be added later as the fence needs increase.

Figure 3:
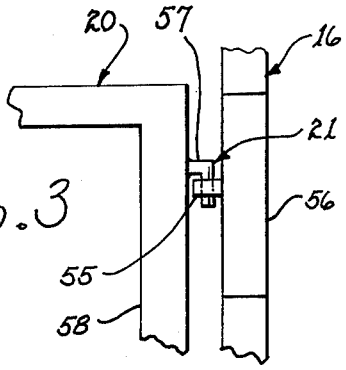
FIG. 3 is a partial sectional view illustrating a means for securing a hinged gate to the dismantleable fence.
Figure 4:
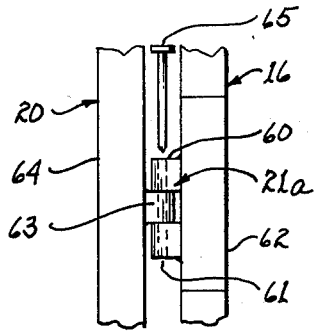
FIG. 4 is a partial sectional view illustrating a variant means for securing a hinged gate to the dismantleable fence.

Referring now to FIGS. 3 and 4, means for readily detachable attaching gate 20 to supporting post 16 will be reviewed. Hinge 21 is developed from an eyelet 55 extending laterally from a spacer 56. A right angle stud or prong 57 extends from frame 58 of gate 20. The prong penetratingly engages the eye of eyelet 55 and the base of the prong, resting upon the upper surface of the eyelet, lends support to the gate. Thereby, hinge 21, and hinges 22 and 23 which are similarly constructed, both support gate 20 and permit pivotal movement thereof with respect to post 16.

The hinge variant **21*a* includes a pair of spaced apart but axially aligned sleeves 60 and 61 secured to spacer 62 mounted upon post 16. A further sleeve 63 is secured to frame 64 to door 20. Sleeve 63 is commensurate in length with the spacing intermediate sleeves 60 and 61 whereby it is snugly positionable therebetween. A pin 65 extends through aligned sleeves 60, 63 and 61 to maintain them in axial alignment with one another while precluding vertical and lateral separation therebetween. Thereby, variant hinge 21*a* pivotally supports gate 20 upon post 16**.

Latch 24 will be described with primary reference to FIG. 1. The latch includes a bar 67 pivotally attached to frame member 68 of gate 20. A flanged receiver 68 is attached to a spacer 69 mounted upon upright 47 of post 13. When the bar engages the receiver, as illustrated, pivotal movement of gate 20 is precluded. Unlatching of latch 24 is accomplished by simply pivoting bar 67 upwardly out of engagement with the receiver. It is to be understood that more sophisticated or differently configured latches can be similarly employed with one part thereof being secured to the gate and another part to an appropriately located spacer mounted upon the upright of post 13.

From the above description, it will become apparent that each of the fence sections are deployable individually for any purpose for which a fence might be used. Moreover, a plurality of fence sections are serially mateable with one another to provide a fence of unlimited length. Each of the elements employed in a fence section is essentially replaceable with a similar element of another fence section. Thus, the fence sections are modular in nature and the erection, as well as the dismantling of a fence is that of serially constructing or taking down fence sections.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

What is claimed is:

1. A takedown modular fence, said fence comprising in combination:

(a) a plurality of posts, each said post including base means for supporting said post and upright means extending from said base means;

(b) a plurality of rails, each said rail including orthogonal end means for penetrably mounting said rail upon two adjacent ones of said uprights;

(c) spacer means penetrably mountable upon said uprights intermediate said orthogonal ends of adjacent ones of said rails for defining the vertical separation between adjacent ones of said rails;

(d) a gate way comprising:

i. a gate;

ii. hinge means for pivotably attaching one side of said gate to one of said posts; and iii. latch means for securing another side of said gate to another of said posts; and (e) a first stanchion extending upwardly from said one post, a second stanchion extending upwardly from said other post and a cross member for interconnecting the upper ends of said first and second stanchions;

whereby, said rails and said spacers are slidably and removably mountable upon respective ones of said uprights to define said fence.

2. The takedown modular fence as set forth in claim 1 wherein said first and second stanchions are nestably secured to respective ones of the uprights of said posts.

3. The takedown modular fence as set forth in claim 1 wherein said orthogonal ends of said rails are nestably slidably mounted upon the respective ones of said uprights.

4. The takedown modular fence as set forth in claim 3 wherein said spacers are nestably slidably mounted upon the respective ones of said uprights.

5. The takedown modular fence as set forth in claim 4 wherein said spacers comprise extensions of said orthogonal ends.

6. The takedown modular fence as set forth in claim 4 wherein said uprights, said orthogonal ends and said spacers are lengths of tubing.

7. The takedown modular fence as set forht in claim 6 wherein said lengths of tubing comprise lengths of square tubing.

* * * * *